US005439230A

United States Patent [19]

Mendes, Jr.

[11] Patent Number: 5,439,230

[45] Date of Patent: Aug. 8, 1995

[54] WATER COLUMNAR RACE GAME

[76] Inventor: John F. Mendes, Jr., 427 15th St., Daytona Beach, Fla. 32117

[21] Appl. No.: 153,138

[22] Filed: Nov. 16, 1993

[51] Int. Cl.[6] ..... A63F 9/14

[52] U.S. Cl. ..... 273/349; 273/371; 273/310

[58] Field of Search ..... 273/349, 371, 374, 375, 273/376, 377, 387, 389, 310, 86 R, 85 H, 311

[56] References Cited

U.S. PATENT DOCUMENTS

| | | | |
|---|---|---|---|
| 2,759,731 | 8/1956 | Quinn | 273/349 |
| 3,336,030 | 8/1967 | Martell et al. | 273/349 |
| 3,342,492 | 9/1967 | Barrett | 273/349 |
| 3,362,713 | 1/1968 | Miller | 273/349 |
| 3,572,712 | 3/1971 | Vick | 273/349 |
| 4,040,622 | 8/1977 | Sinnott | 273/349 |

*Primary Examiner*—Mark S. Graham
*Attorney, Agent, or Firm*—Charles E. Lykes, Jr.

[57] ABSTRACT

A game in which two or more players compete to fill a column of water by engaging a target with a fluid or solid projectile stream or a light beam. Detectors upon a target are adapted to signal a separate water pressure device in order to force water from a reservoir up into and through a transparent or translucent column. At the top of such column a detector awaits the rising column of water in order to signal its arrival and indicate the success of the player in engaging his or her respective target. The apparatus can be configured so that each player's column is filled from a separate reservoir or from a common reservoir.

17 Claims, 11 Drawing Sheets

WATER COLUMNAR RACE GAME

FIELD OF THE INVENTION

The invention relates to games in which a player seeks to accurately direct some form of stream or beam onto a target, particularly those forms of such games in which the player's success in such activity propels racing objects such as are typically found in arcades. Additionally, the invention relates to such games in which water is manipulated.

BACKGROUND OF THE INVENTION

Amusement parks, state fairs and carnivals, and in recent years, family entertainment style restaurants (such as Chuck E Cheese's (R), Discovery Zone (R), and others) require a wide variety of carnival and arcade-style games. Such games may be managed by an attendant or may be solely coin-operated and automatic. While many such games are suitable for the entertainment of one person alone, many such games are designed to result in competition among two or more players.

One common variety of such games are those in which players advance a racing member along some path by directing a flow of projectiles, water or fluid steams, or in some cases light beams against a target. The accuracy and the facility in which a player can keep the requisite flow of projectile, light, or water on the target, the faster the player's character may be moved along the path.

There are a variety of other water games. Water games are attractive to many people because of the designs and sensation of floating that is presented by a display of water. For instance U.S. Pat. No. 4,136,872 issued to Matsumoto on Jan. 3, 1979 comprises a game very similar to basketball in which a basketball suspended in water is controlled by jets of water caused by the manual manipulations of two players. The object is to force the basketball through the water and into a given player's goal.

Another water game is taught in U.S. Pat. No. 3,586,323 issued to Carter on Jun. 22, 1971. Carter teaches an aquatic game wherein buoyant balls are placed in a floating receptacle through inlets located below the surface of the water. In the game taught by Carter a buoyant object such as a ping pong ball is manipulated into an underwater or submerged inlet and travels through the column of water up into a basket. The player does not control the flow of water into and out of the column of water but is challenged to get the ball into the proper column.

U.S. Pat. No. 4,305,580 issued to Tourand on Dec. 15, 1981 teaches another form of aquatic game. Very similar to Matsumoto, the apparatus taught by Tourand challenges the players to control objects suspended within a fluid by creating jets of water or fluid currents. The reservoir area of Tourand is adapted to be filled with water during play and evacuated from the playing after play. It is, however, the manipulation of the objects within the filled playing area that forms the object of the game and not the act of filling the playing area itself.

U.S. Pat. No. 5,100,156 issued to Mayne on Mar. 31, 1992 comprises a generally cylindrical transparent chamber which houses a fluid and has a series of game elements within the chamber which may be activated by bellows-type pumps. In that respect the apparatus taught by Mayne is very similar to the apparatus taught by both Matsumoto and Tourand in that liquid- suspended objects are manipulated within a liquid playing area. One distinction between Mayne and the other games is that the play of the game depends upon the flow of liquid both in and out of the chamber to cause the movement of the game pieces. Even so, it is not the act of filling the playing area with fluid that comprises the progress in the game, but rather the manipulation of objects within the fluid.

It should be noted that, in the racing games, the display of the racing members and the housing of the related mechanism for controlling the game typically result in the view of the play of the game being somewhat restricted. In particular, the racing members must usually be placed within a single plane and because of the related game housing, are only visible from one side of a barrier. This limits the number of players which can play the game at one time and it also causes the game to be closed off from many directions.

It would be helpful to develop such a racing game which would allow automatic or supervised competition between two or any number of players and would possess the aesthetic attributes of water games. It would also be helpful to have such a game which would permit reasonably unimpeded viewing from any point surrounding the play of the game.

What is not provided in the prior art is a racing game in which players can participate from any point on a 360 degree radius about the game-playing area. Additionally what is not provided in the present art is a racing game in which the progress of the players is indicated by the filling of a column or other fluid-holding chamber with a fluid substance.

SUMMARY OF THE INVENTION

The inventor has overcome the shortcomings of the prior art by devising a racing game in which the racing apparatus actually comprises separate columns of rising water. Such columns of fluid are housed within glass tubes or pipe which stand upright. Accordingly, the progress along the race course is evidenced by fluid which rises within each player's respective column.

Since both the columns and the fluid within them are transparent or translucent, each column can be observed in a 360° radius and the columns of other players can also be observed in a 360° radius. Additionally, the light transmissive properties of water and glass permit the columns to be useful in creating a variety of color and visual displays since either glass or fluids (such as water) may be easily filtered or tinted for various color effects.

The inventor has achieved this by providing game apparatus which generally comprises a series of launching guns or firing mechanisms, a corresponding series of detectors to receive projectiles or streams from such launching or firing implements, communication means between the target sensors and valves which may be used to fill or drain the various water columns, and light or detection mechanisms to determine the first player to completely fill their respective water column.

In variations of the game, it will shown that the game can be adapted for as few or a great many other players. Additionally, the game could be operated by an automatic coin-operated mechanism or by the use of an attendant.

It should be noted that the game exists in two basic forms. While both of these forms depend upon a rising level of water within a fluid chamber to mark the progress of the play, there is a substantial different between the way that the rising water is accomplished. In a first and preferred embodiment, the game fluid is in fluid combination with a common fluid reservoir and fluid from the reservoir is pumped into and drained from a number of fluid columns from the same reservoir. The pumping is accomplished by means of a pressurized game fluid main which is in fluid communication with each of the fluid columns through separately controlled inlet valves.

In another embodiment of the game each of the fluid columns is adapted with its own fluid reservoir and each fluid reservoir is separately actuated to cause the fluid to rise or fall within each respective player's column.

It is, then an object of the present invention to provide a racing game in which progress along a race course is evidenced by fluid rising within an upright column.

It is a further object of the present invention to provide such a columnar fluid racing game in which the rising fluid is activated by the success of a player in directing a series of projectiles, a stream of water, or a beam of light against a target.

It is further object of the present invention to provide such a game in which a wide range in number of players can participate at one time.

It is a further object of the present invention to provide such a water race game in which the play and progress of the race can be observed at points all around the play of the game by each other player.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

DETAILED DESCRIPTION OF THE PREFERRED EMBODIMENT

Reference will now be made in detail to the present preferred embodiment of the invention, an example of which is illustrated in the accompanying drawings. While the invention will be described in connection with its preferred embodiments, it will be understood that it is not intended to limit the invention to those embodiments. On the contrary, it is intended to cover all alternatives, modifications, and equivalents as may be included within the spirit and scope of the invention as defined in the appended claims.

Figure 1:
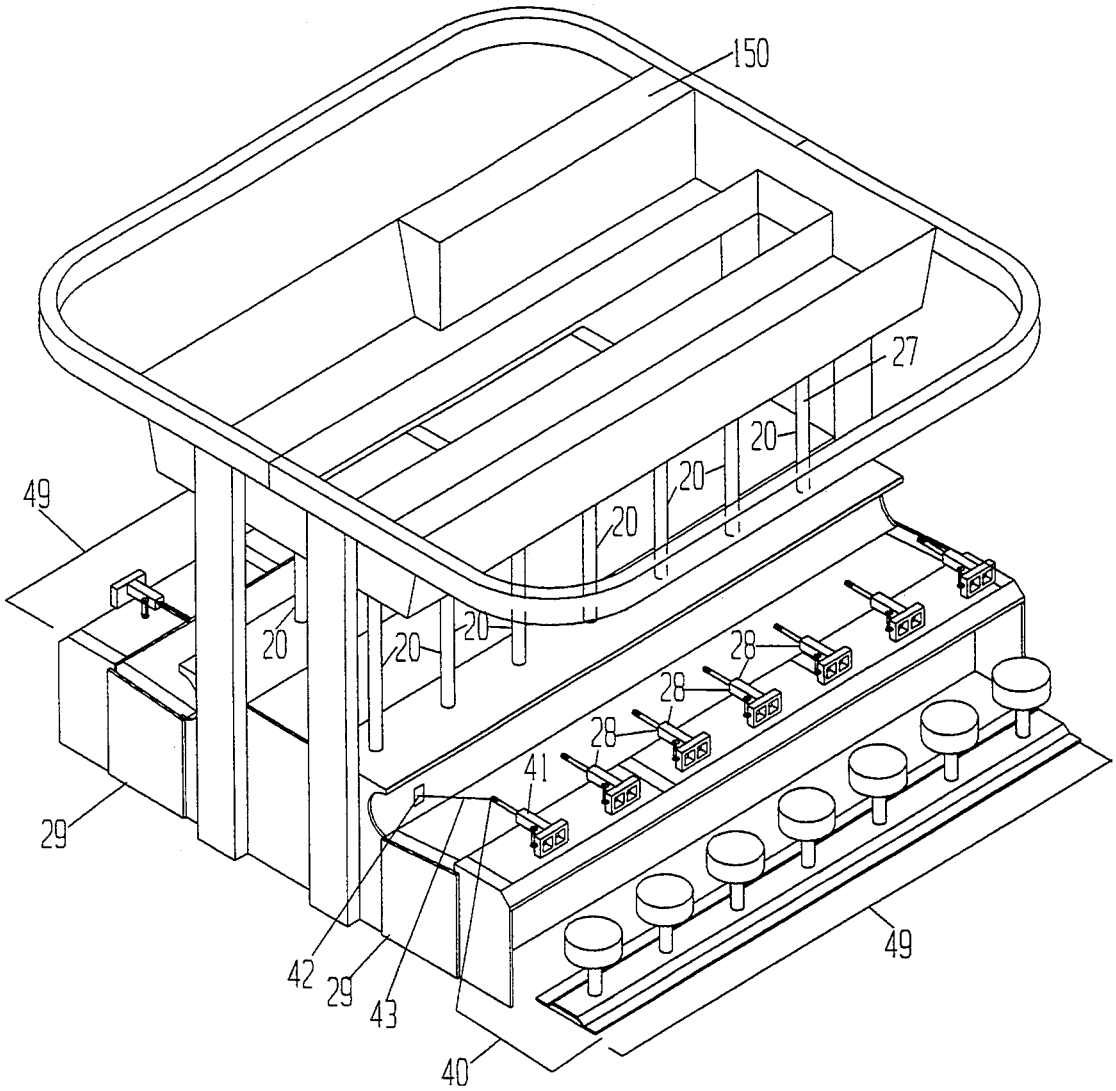
FIG. 1 is a depiction of the overall game as would typically be used in an amusement park setting.

Making reference first to FIG. 1, the major components of the arcade version of the water race game are shown A series of columnar fluid units (20) are shown arrayed in a generally rectangular formation. A series of playing positions (40) corresponds with each of the columnar water units (10). Each of the corresponding playing positions (40) further comprises, in this case, a target fluid gun (41), and a target (42). The target fluid gun (41) is adapted to direct a pressured stream (43) of water or other target fluid with sufficient accuracy that it may be detected by one or more target contact detectors (not depicted in FIG. 1).

Playing positions (49) are depicted in two rows (29) generally facing each other with a dozen positions for shooting water guns (28) at a target area (49), each target area (49) further being equipped with a water column apparatus (27). It can readily be seen that each playing position (49) affords a view each water column apparatus (27). The required electronics may be housed in a shroud (150) or other protective enclosure on the top of the covered apparatus (151), which may be otherwise adapted with visual or audial displays (such as sirens, whistles, neon or other colored lights, or other displays) in order to make the game more enticing to passers by. The fluid reservoirs and mains (not depicted in FIG. 1) may be housed and hidden away in a similar shroud or in a storage compartment beneath the columns.

Figure 2:
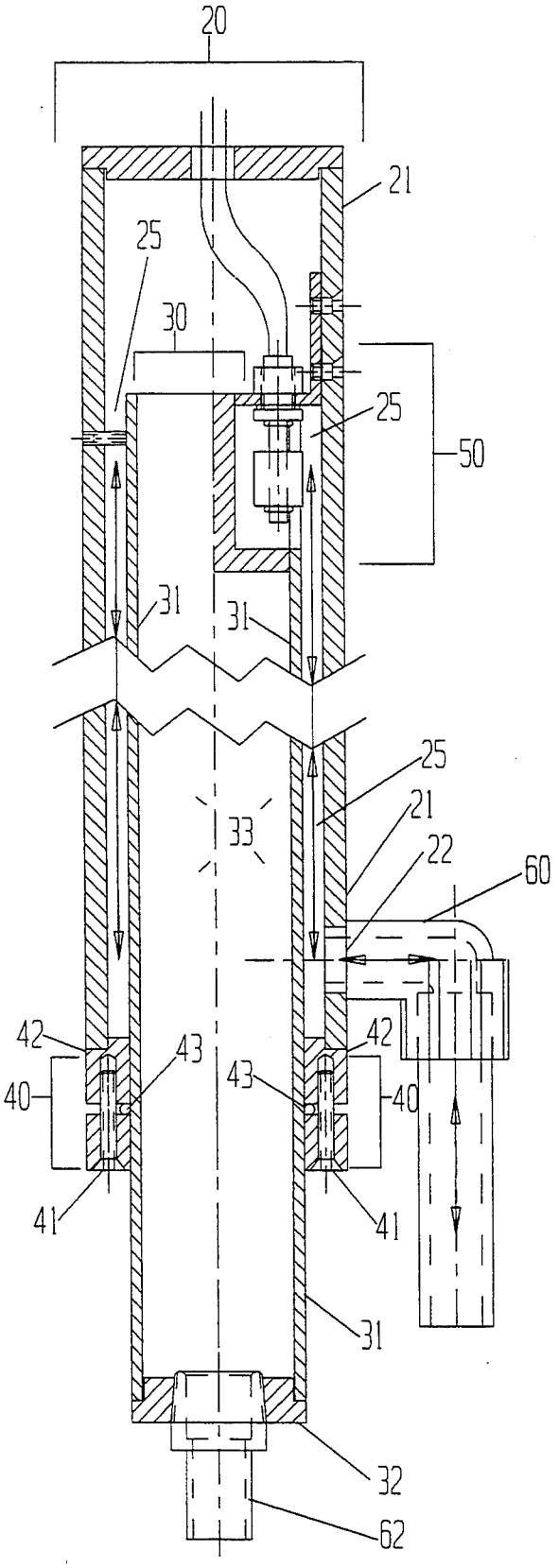
FIG. 2 is a side view of one of the columnar water units.

Making reference now to FIG. 2, a side view of one of the columnar fluid units (20) as designed for use in the amusement park setting will be described. Such apparatus generally comprises an outer column wall (21) which is generally oriented vertically, within which is further housed an inner column (30) as evidenced by the inner column wall (31). It should be noted that each of these columns (20, 30) are generally described and depicted as cylindrical, but could also be of other cross-sectional geometries. FIG. 2 also depicts a fluid inlet conduit (60) through which a fluid can be passed to within the outer column wall (21) through a port (22).

FIG. 2 also depicts an outlet fluid conduit (61) which passes through an escape port (62) in the bottom surface (32) of the inner column (30). FIG. 2 further depicts that there is a space between the outer and inner column walls (21, 31). The two columns (20, 30) are joined by a seal (generally 40), which comprises an inner column ring (41) and an outer column ring (42) both of which are interconnected by seal with an O-ring (43). While this method of connecting the inner and outer columns (20, 30) has been described, it should be noted that other means of sealing a connection between concentric columns could be used. What is important is that a fluid-tight seal (43) be formed at this point.

It should also be pointed out that FIG. 2 depicts a float switch apparatus (50) near the top (34) of the inner column (30). This float switch may, but need not, be housed within a space (35) created by invading the space of the inner column (30). What is important about the float switch apparatus (50) is that it is in fluid communication with the space between the outer and inner columns (20, 30). The float switch apparatus (50) will be described in greater detail later.

What is important about FIG. 2 is that it creates a path for the flow of a fluid from an inlet conduit (60) into the space (25) between the outer and inner columns (20, 30), up over the top (34) of and down into the inner column space (33) and out through the bottom (32) of the inner column through the escape port (62).

Figure 3:
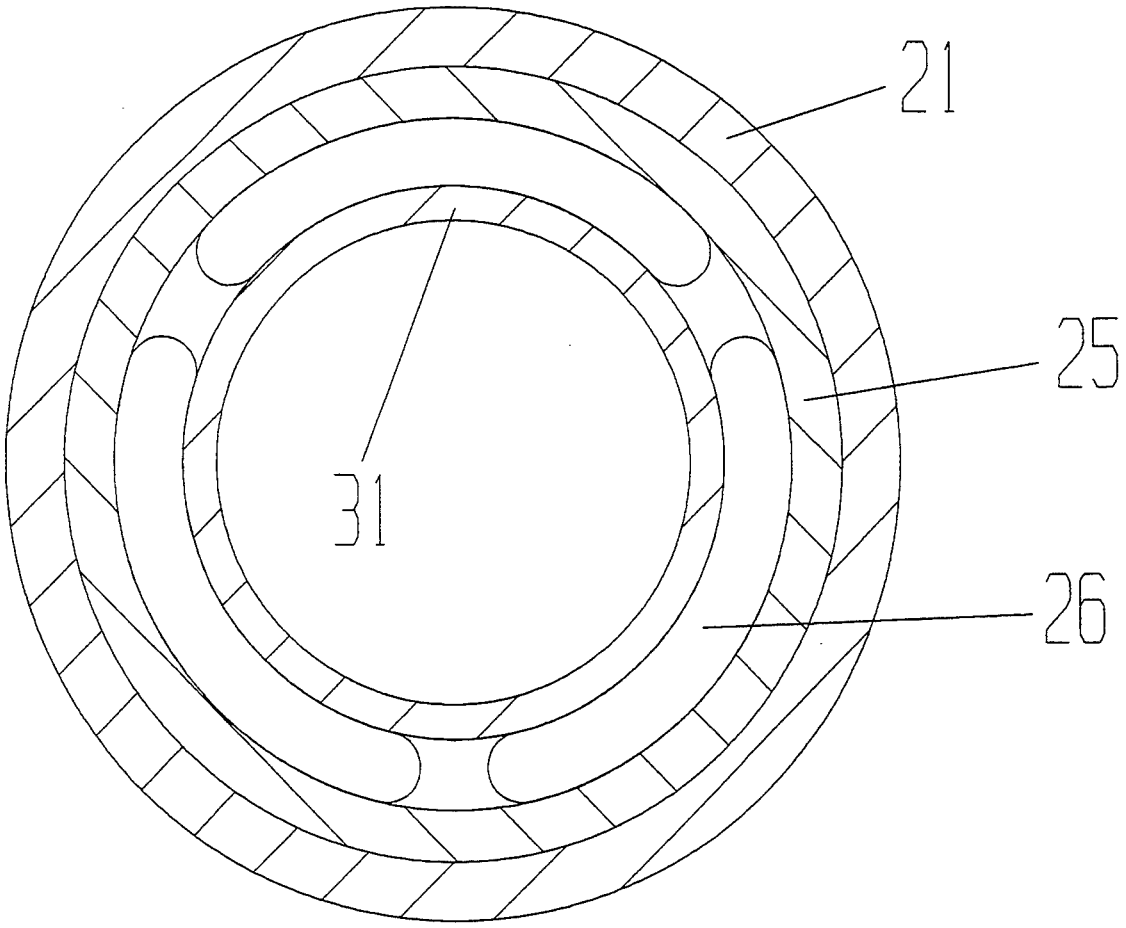
FIGS. 3 depicts a cross-section view of such a columnar water unit at a midpoint along its length.

Making reference to FIG. 3 a cross-section view of the columns (20, 30) along the midpoint, it can be seen that the space (25) between the columns (20, 30) may be quite narrow. It can also be seen that spacers (26) may be used at the bottom or some other position to keep the columns (20, 30) stable in position with respect to one another.

Figure 4:
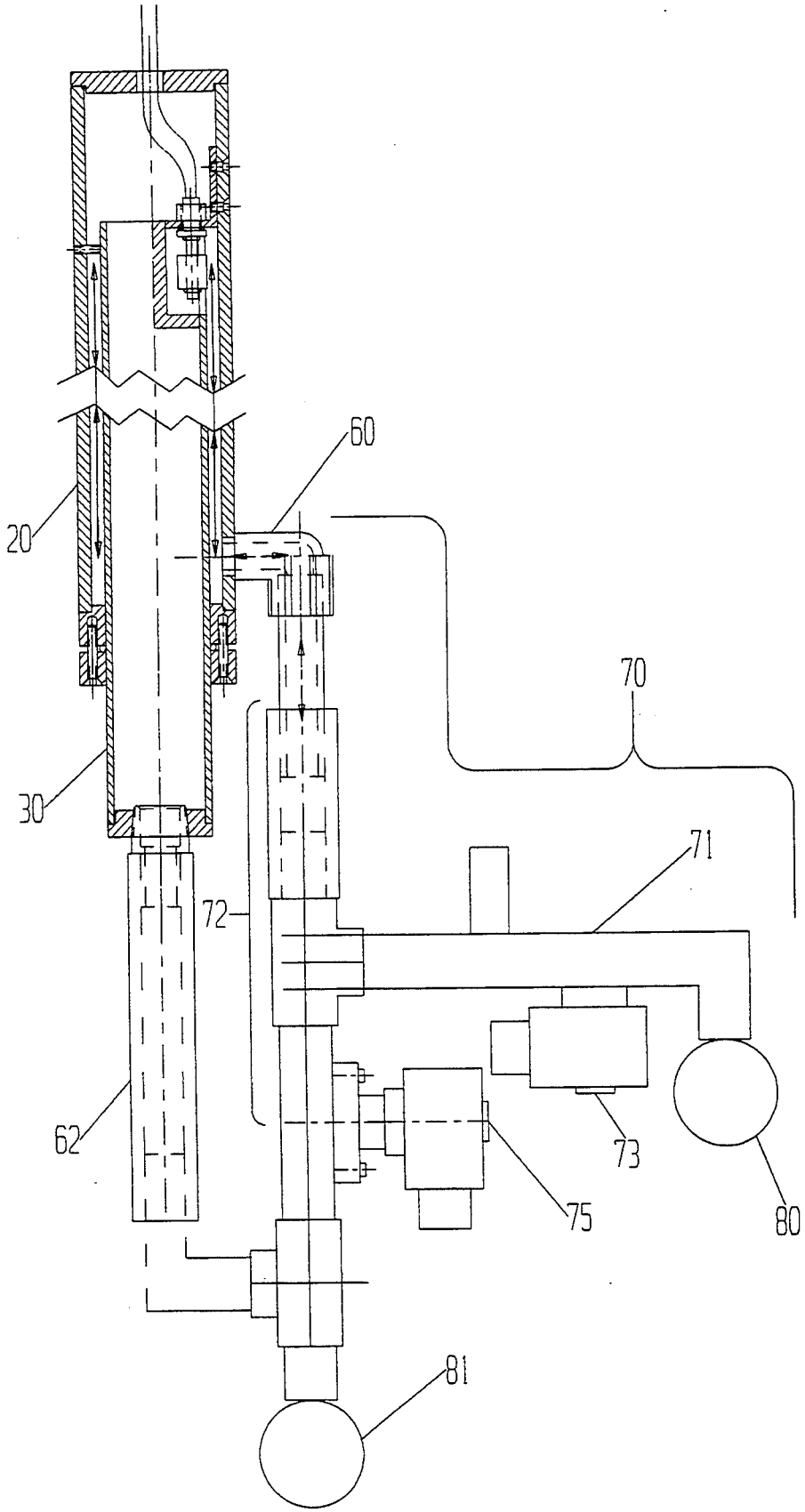
FIG. 4 depicts the valve communication between a reservoir of water and a columnar water unit in the amusement park version of the game apparatus.

FIG. 4 depicts the fluid network necessary to achieve the results desired in the conduct of the game. Seen connected to the outer and inner column apparatus (20, 30) described previously is a T valve apparatus (70). The T valve apparatus comprises a pressurized fluid connection conduit (71) which is in fluid connection between a pressurized fluid main (80) and a fill/drain conduit (72). The fluid communication through this fluid connection conduit (71) between the pressurized main (80) and the fill/drain conduit (72) is controlled by a fluid inlet valve (73). Also depicted in FIG. 4 is a fluid outlet valve (75) which acts upon the fill/drain conduit (72). By opening this fluid outlet valve (75), fluid communication can be established between the fill/drain conduit and a reservoir return main (81).

Figure 5:
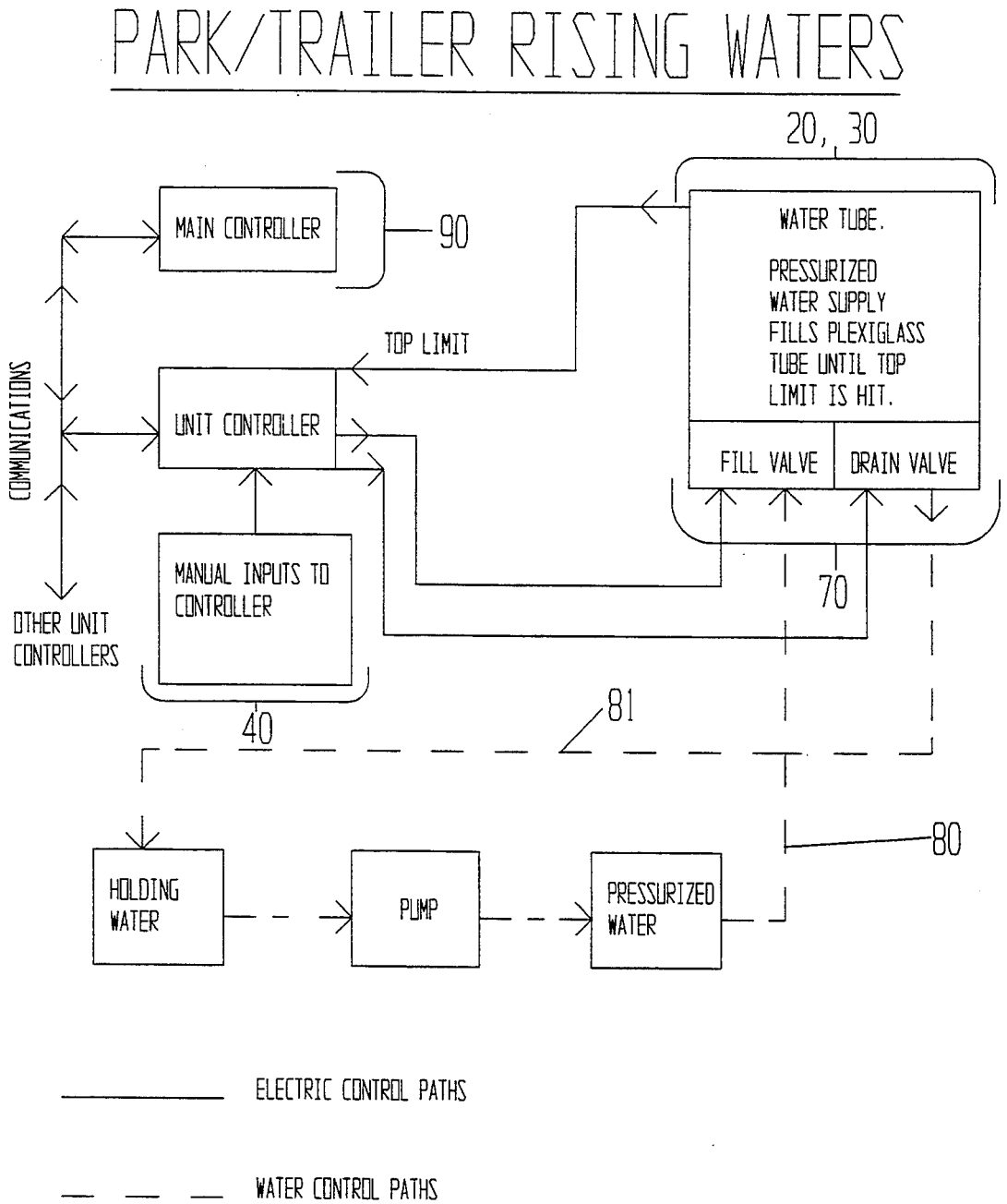
FIG. 5 is a block diagram of the major components of the amusement park version of the game apparatus.

FIG. 5 depicts schematically the operation of the park embodiment of the invention. It is noted at the outset of this discussion that a variety of technologies and mechanical functions will be herein described which are well known in the art. Such includes the art of supplying a variety of fluid valves from a common reservoir through a pressurized main. Such also include the art of detecting the presence of a flow of projectiles or light upon points on a detector by means of photoelectric cells or electro-mechanical and electro-magnetic detectors.

The art of relaying the signals from these detectors to control switches through desired digital or logic circuitry programmed to achieve specific results is also well known. Consequently, no effort is made to claim such features herein and detailed descriptions of the operation of such devices may be omitted. It should be noted that a variety of devices are readily available to achieve such results and each should be understood to fall within the spirit and scope of the present invention.

From FIG. 5 then, it can be seen that there are both a fluid pressure network and an electrical signalling-/control network. Fluid may be transported from a common reservoir to the T-networks (70) of each columnar unit (20) by means of the pressurized fluid main (80). Fluid inlet valves (72) may be opened and fluid outlet valves (75) may be closed in order to permit pressurized fluid to flow into the space (25) between the outer and inner columns (20, 30).

The fluid outlet valve (75) may be used as a return valve. When the fluid outlet valve (75) is opened, fluid is free to flow from the columnar fluid unit space (25) back into the fluid reservoir through the return main (81). Accordingly, if valve (72) is open and valve (75) is closed, whatever fluid pressure if available in the main will force fluid from the pressurized fluid main (80) up into the columnar water unit space (25). In practice, a master controller (90) will be used to close each of the respective fluid outlet valves (75) at the start of a competition. As each player engages his or her target (40) one or more sensors (not depicted) on the target would be in electrical communication with a relay which opens and closes the fluid inlet valve (72) on that player's respective columnar water unit (20).

This forces fluid up into the space (25) between the columns (20, 30). At a point near the top (34) of the inner column (30) a float activated switch (160) (or any other form of desired fluid detector) would be available to receive the fluid and signal that the fluid has risen to that level. All of these fluid level detectors for each game would be connected to a common signalling network programmed to signal the first player to reach that level and then end the game. Such could also be used to initiate a light or sound show or otherwise entertain the players.

The master controller could then be set to close all of the fluid inlet valves (72) and open all of the fluid outlet valves (75) in order to drain the column space (25) and start the game over. In the event of overflow from the column space (25), the overflow could travel through the interior space (33) of the inner column (30) and back to the fluid reservoir (90) through the outlet fluid conduit (61) and outlet port (62).

As envisioned and generally described, the columnar water unit comprises both inner and outer columns (20, 30) Rather than occupy the entire interior of such an apparatus, the rising fluid only occupies the space (25) between these columns (20, 30). This configuration proves useful in conserving the fluid and pressure to cause the fluid to rise. It also provides a fluid escape route in the event fluid continues to rise after having reached the top (34) of the inner column (30). It should be noted that the general principle of a rising fluid race game could be achieved with a single and totally hollow water column, a column which is not exactly upright but somewhat slanted, or columns which are curved or otherwise irregularly shaped.

By way of general discussion, it is offered that the principles of the invention require only that the appropriate fluid paths and controls are offered to achieve the filling and draining of the various columns according to the controls and that each respective playing position and fluid column offer an equal fluid path and means to activate it. Other variations of fluid flow and control networks could be found in keeping with the spirit and scope of the present invention.

One noteworthy alternative is possible with respect to the level of target detection sophistication. Such could comprise a single detector which is adapted to turn the fluid inlet valve (72) either on or off. An alternative would be to provide the target with several detectors, perhaps progressively closer to a "bull's eye", and cause the fluid inlet valve (72) to be directed to a range of open positions in order to reward a player for achieving a stream on the target closer to the "bull's eye".

At an appropriate time, a game superintendent or automatic controller could close all of the pressure valves and cause the return valves to be opened. This would cause the water or other fluid to be returned to the reservoir.

Figure 11:
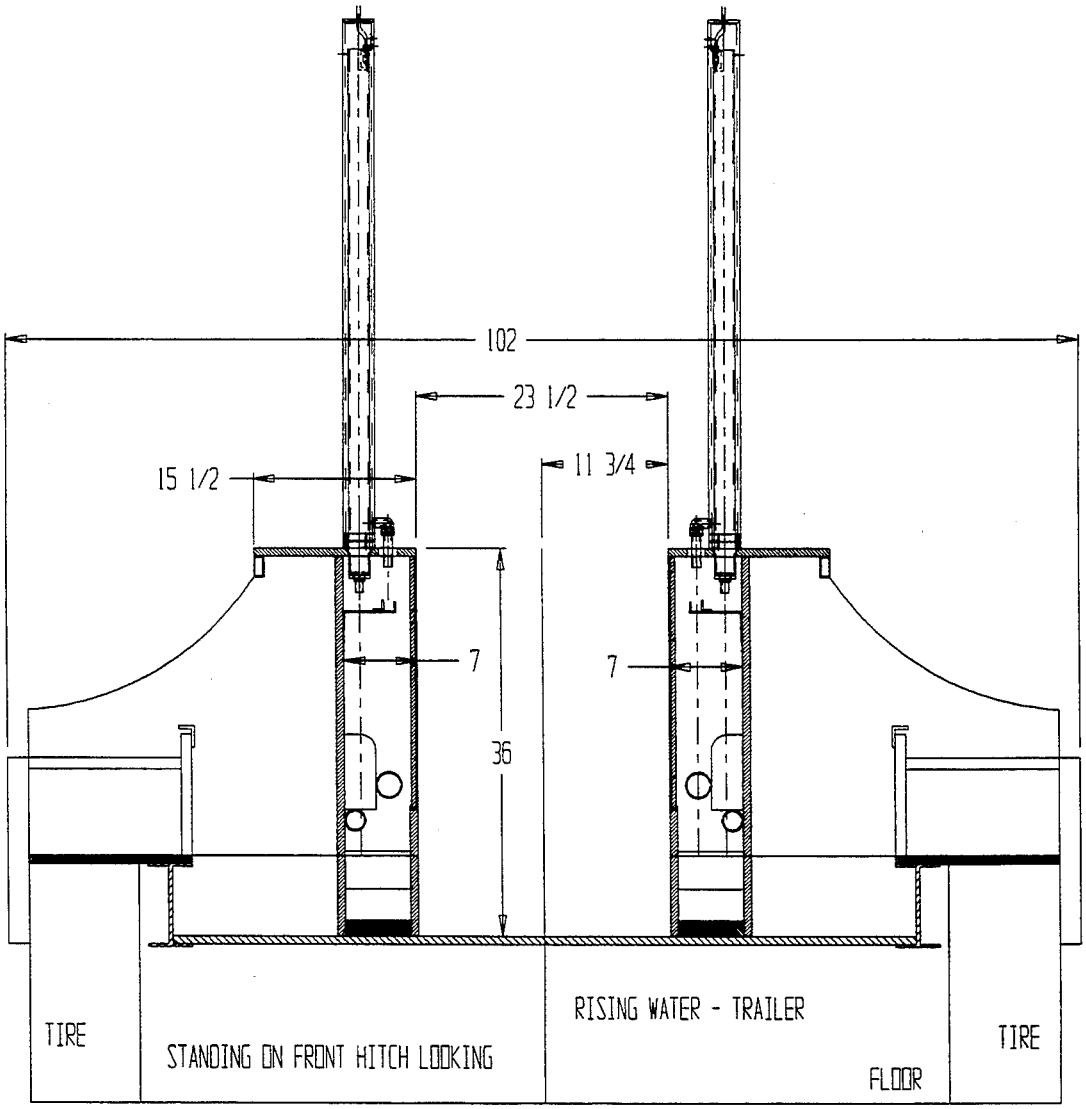
FIG. 11 depicts a rear view of the park embodiment demonstrating that it may be mounted and towed on a trailer.

In order to more fully understand the advantages of the present invention it is helpful to see depictions of the apparatus as installed for use in its various alternate embodiments. FIG. 11 depicts the front exterior view of the embodiment of the apparatus (having been referred to as the "park" model), which is adapted to be towed on a trailer for use in a carnival, boardwalk, or breezeway.

While the apparatus has been depicted with respect to such an apparatus with two rows, it is clear that any geometric configuration could be used which permits a series of playing positions to be aligned about some perimeter. Such could include a circle, triangle, or other regular or irregularly shaped polygon.

While the preferred embodiment of the present invention has been described in terms of a game suitable for an arcade, it should be noted that as few as two players could be in competition with one another in such an apparatus. In fact, the principles of the present embodiment of the invention could be practiced by a single playing position in which a player could time the progress of the rising water within the columns and, by playing the game over and over again, seek to improve skills by obtaining lower and lower periods of time required to cause the columns to rise to the top.

Figure 6:
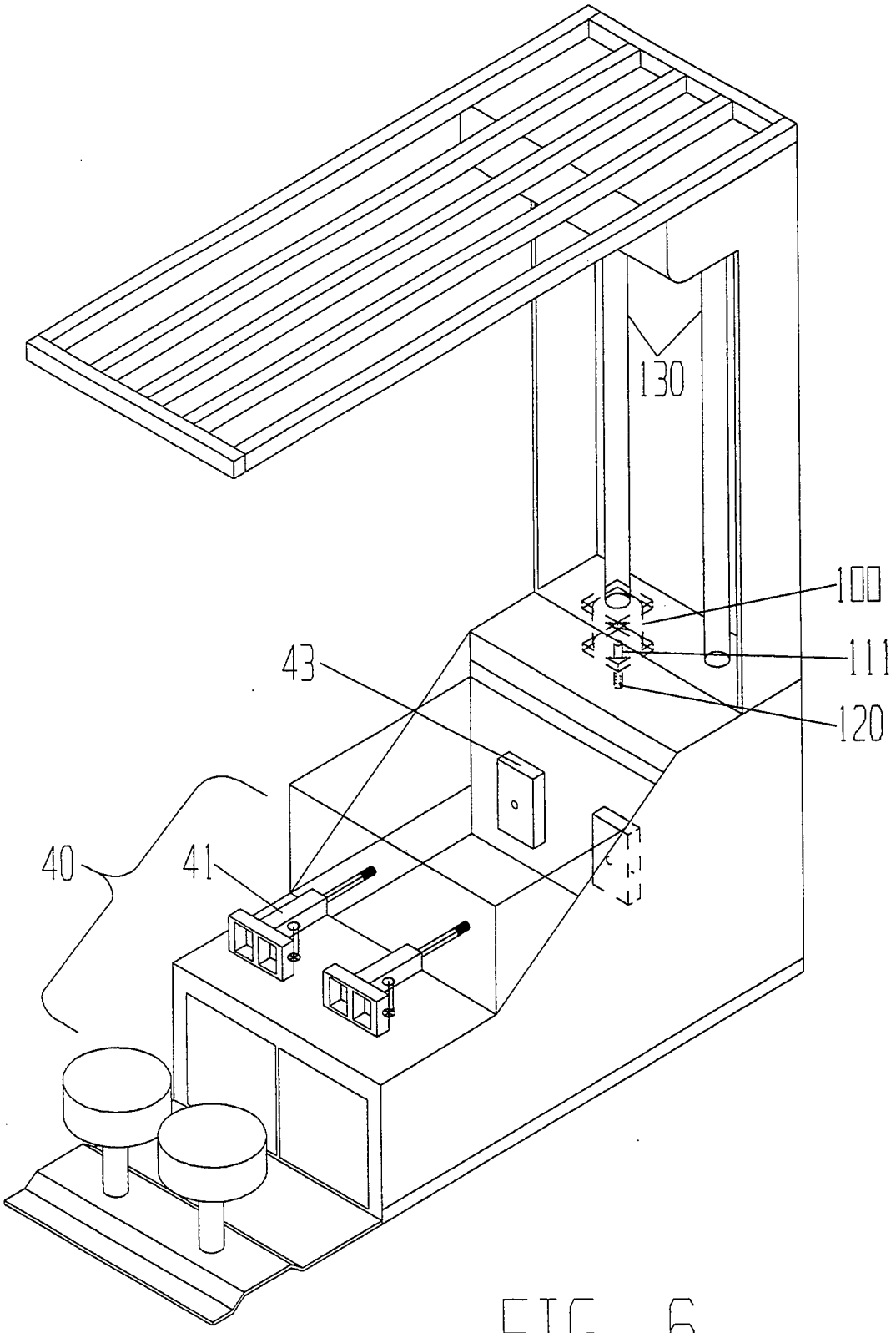
FIG. 6 depicts a version of the overall game apparatus which would be suitable for use in smaller arcades and by fewer players.

Depicted in FIG. 6 is an alternative embodiment of the invention designed for use in smaller facilities and by smaller numbers of people simultaneously. The convention of referring to this model as the "arcade" model has been adopted. The model depicted is configured for use by two players.

Figure 7:
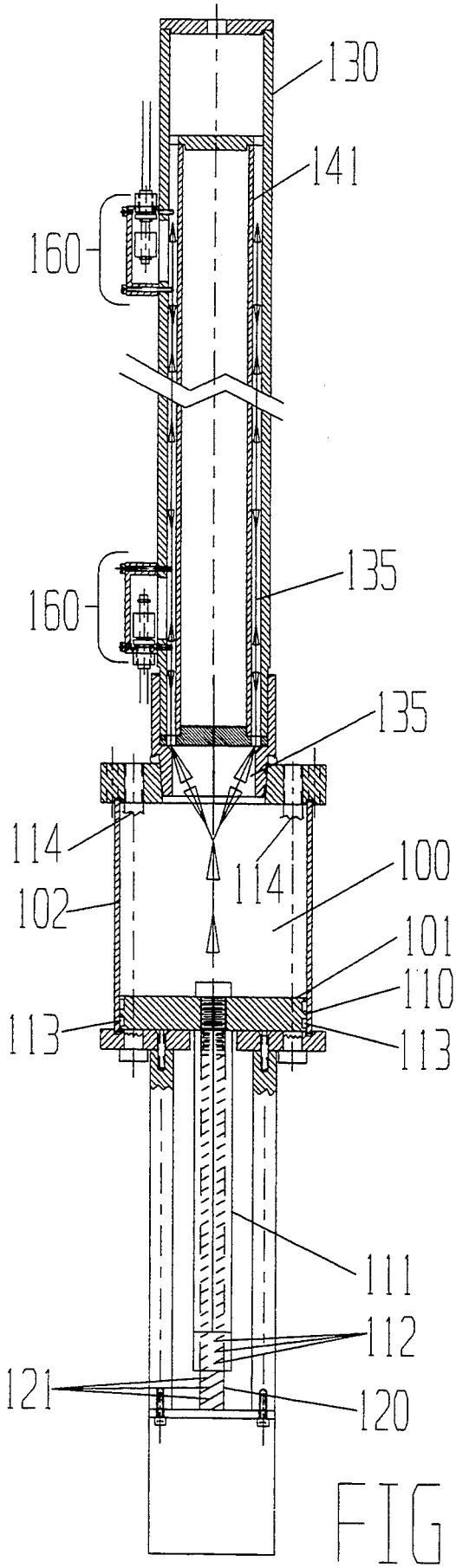
FIG. 7 depicts a side view of a water column according to the arcade version of the apparatus.

Reference is made to FIG. 7 in which it can be seen that in the "arcade" version of the apparatus, each playing position is equipped with its own fluid reservoir (100). This reservoir (100) may be a cylinder within which the fluid may be stored. The floor (101) of the reservoir is formed by a cylindrical piston member (110) which is mounted upon a hollow shaft (111) which, in turn, concentrically surrounds a rotating and threaded shaft (120). At some point along the hollow shaft (111), matching threads (112) are in screw communication with the threads (121) of the rotating shaft (120)such that the rotation of the rotating shaft (120) raises or lowers the piston (110) member within the cylindrical reservoir (100).

The piston member (110) is equipped with O-ring members (113, 114) in order to ensure sliding contact along the inner wall (102) of the cylindrical reservoir (100) which will be fluid-tight and not permit the seepage of any fluid through the bottom of the reservoir (101) or around the piston member (110). The top (104) of the cylindrical reservoir (100) opens into a space (135) between inner and outer columns (130, 140) configured very similarly to those in the park embodiment of the invention. As the piston (110) forces fluid up through the cylindrical reservoir (100) and fills it, some of the fluid is driven up into the fluid column and begins to fill the between column space (135).

As with the "park" version of the game, an inner column (140) is used to fill some of the interior space of the outer column (130) and reduce the amount of fluid and fluid pressure necessary to play the game. One difference between these two versions of the apparatus is that no overflow path for the fluid is provided down through the interior of the inner tube (140). This is possible because there is no longer a common reservoir to receive any fluid and that overflows are prevented by restricting the available fluid supply within the reservoir (100) or by restricting or limiting the range of motion of the piston (110).

Figure 8:
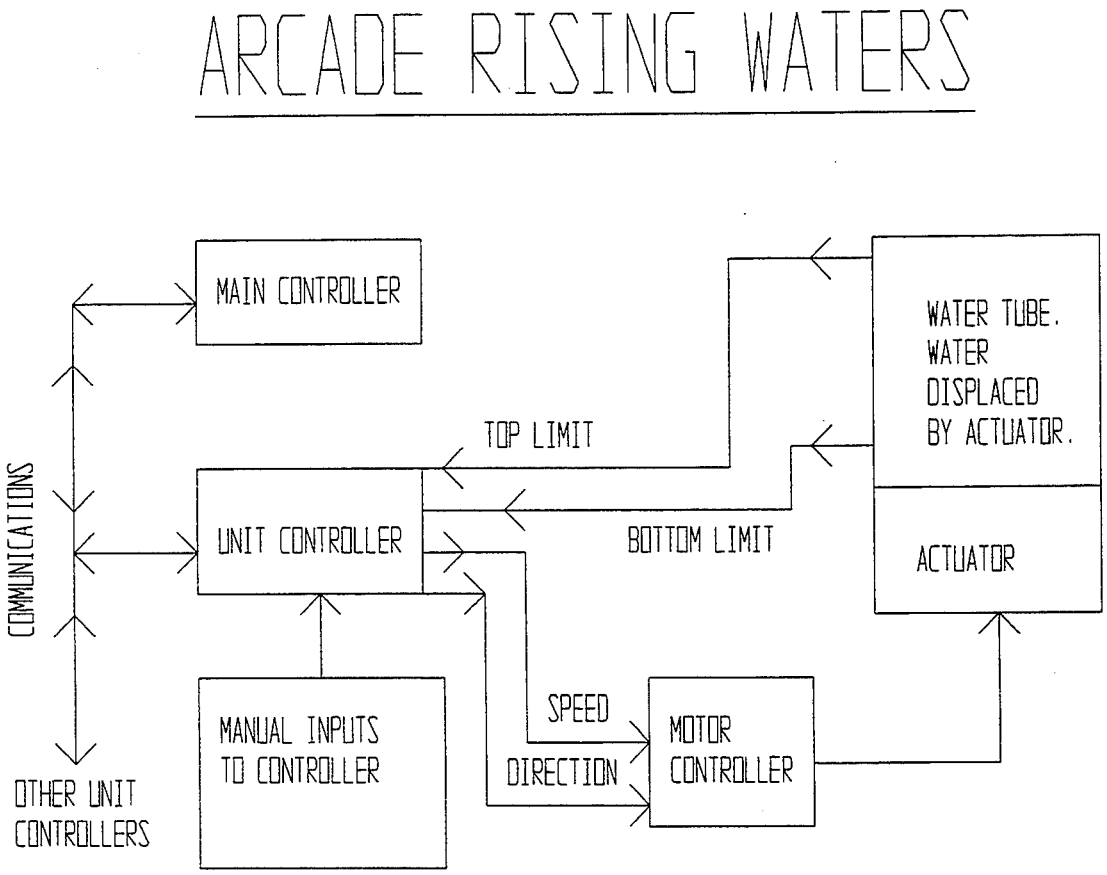
FIG. 8 depicts a block diagram of the combination of components necessary to operate the arcade version of the apparatus.

FIG. 8 depicts the simplified circuitry required to operate this arcade embodiment, which would normally accommodate fewer players and may be made capable of coin operated, automatic operation. The target detection circuits may alert the actuator to turn and cause the piston (110) to rise into the reservoir (100) and force fluid into the between column space (135). Once one of the fluid columns reaches the float activation switch (109), the master controller is signalled that the game is over and the actuator is reversed to return all of the pistons (110) to the lower and allow the fluid to return to the reservoir (100).

The fluid detection means, target detection means, master control means, and float activated switch of this "arcade" model could (but need not) be the same as the "park" version. In either version of the apparatus, it should be noted that a variety of signalling and detection means could be used in keeping within the spirit and scope of the present invention. Additionally, it should be noted that the variety of such fluid level detection means are well known in the present art and are not meant to be included within the scope of these claims. Accordingly, no effort is made to describe such elements beyond demonstrating one such possibility and to point out that any variety of such devices as may be found in tanks or overflow warning devices could be adapted for use herein.

Figure 9A:
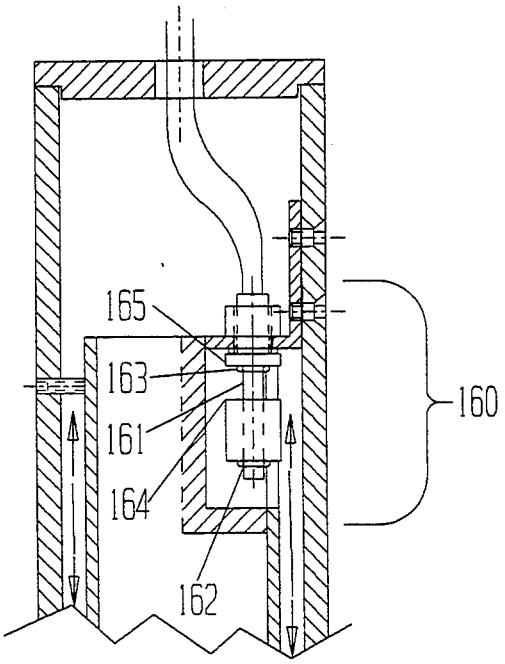
FIGS. 9A and 9B depict a float activated detector in the rest position and in which the float makes contact with an upper sensor to signal the winning of a race respectively.
Figure 9B:
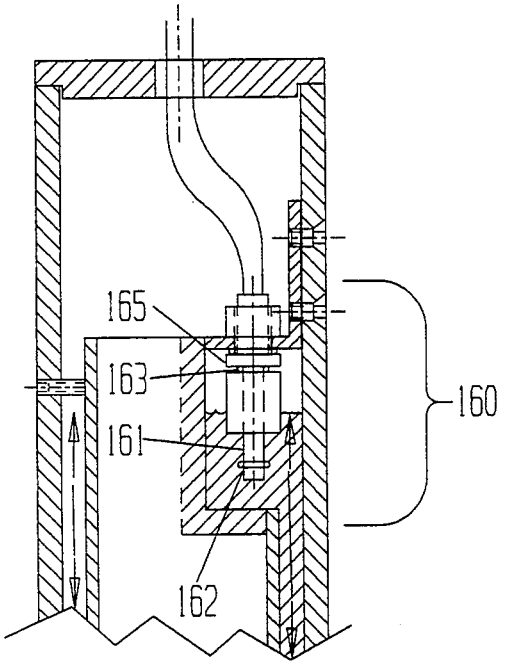

References have been made to a float activated switch used to detect the arrival of a column of fluid at the top or game-winning position in either embodiment of the invention. Each could be adapted with the same such apparatus. One means in which the float activated switch could be configured is as depicted in FIGS. 9A and 9B. A float (160) is positioned about a shaft (161) so as to be free to slide along its length from a point of rest (162) and up to a switch (163). When the fluid rises to the level of the float, the float will rise along the shaft (161) until float sensing wire (164) makes contact with the detecting member (165). This may trigger the signal to the controlling circuitry.

Figure 10:
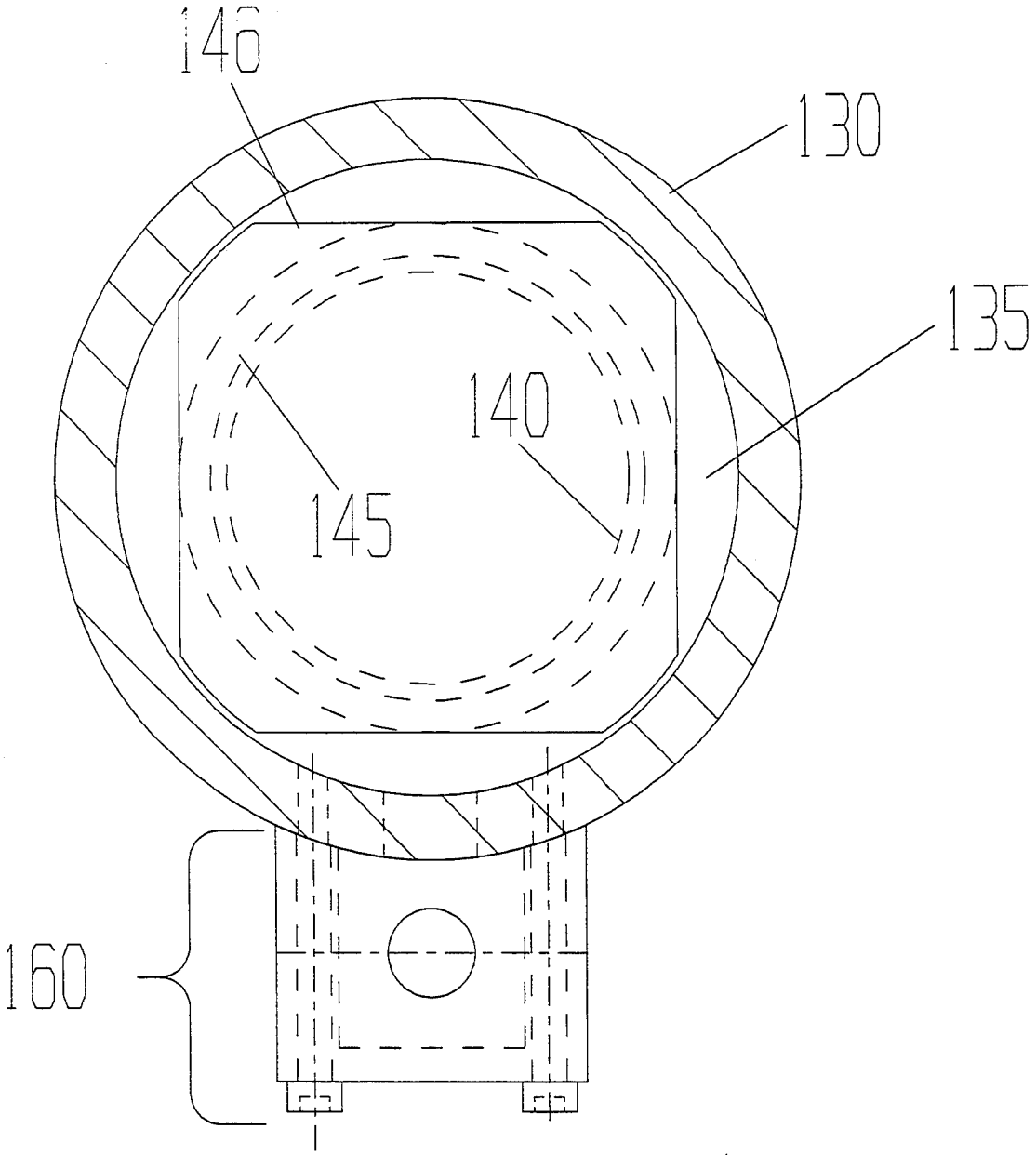
FIG. 10 depicts a cross-section view of the arcade embodiment of the invention depicting the float activated switch on the outside of the outer column.

A consideration of using the tube within a tube configuration is to minimize the amount of fluid required to fill the column by creating a void in the center. Accordingly, the positioning of a switch apparatus within this space may not be feasible. In order to solve this problem, a compartment may be established which intrudes to within the space of the inner tube. Such a compartment can be seen in FIG. 2. Making reference to FIG. 10, a cross-sectional view of the arcade version is shown in which it can be seen that such a float activated switch (160) could also be fixed in a compartment on the outside of the outer column (130). In FIG. 10 it is also seen that in the arcade embodiment of the invention the inner column top (145) is closed with a cap (146) in order to prevent fluid from splashing or otherwise sloshing into its interior.

As previously mentioned, a variety of electrical options and accessories in signalling and detection are available to enhance the operation of the present invention. For instance, the upper column sensor could be in communication with a particular pattern of light or sounds or could to nothing more than light a single bulb to indicate that a position has won a given race.

While the firing mechanism has been described in the terms of a water gun, it should be noted that any projectile, stream, or beam device could be used to communicate with an appropriate target detector. For instance, a gun could be an air-pressure gun and could be fed with a steady stream of small light-weight pellets. These pellets could be fired in rapid succession at a target. Additionally, some fluid other than water could be used in such a gun.

It is doubtful that any fluid could be as effective as water given its relatively low cost and the ease with which water could be dyed or colored for effects. Nevertheless, it should be mentioned that alternatives could be used. Additionally, the gun could be operated without the use of any projectile at all. A beam of light could be detected by a photocell to achieve the same result.

Additionally, the water fluid could be dyed or the glass or transparent columns could be tinted to allow the display of different numbers.

Finally, given the light reflective and refractive qualities of glass and water, lights could be directed at or placed in proximity to the various water columns in order to create unique and attractive light designs within the given water columns and glass enclosures.

Further modification and variation can be made to the disclosed embodiments without departing from the subject and spirit of the invention as defined in the following claims. Such modifications and variations, as included within the scope of these claims, are meant to be considered part of the invention as described.

What is claimed is:

1. A competition game in which two or more players seek to cause respective columns of water to rise within a designated generally vertical column, the game apparatus comprising;

two or more player control means and targets, each said player control means further comprising a player firing mechanism which is capable of permitting a player to direct either a fluid or solid projectile stream or a light beam onto or about a target, said target being further adapted with a detection means which is adapted to detect the presence of said fluid or solid projectile stream or light beam, and signalling means which is adapted to transmit a signal to a respective fluid control means during times in which a player's respective fluid or projectile stream or light beam is detected by said target detection means;

respective fluid control means, each said respective fluid control means further comprising a respective game fluid reservoir which further comprises a fluid storage container, a game fluid conduit between said game fluid storage container and a generally vertical column, and a piston member, said piston member adapted to alternatively compress the game fluid storage container so that game fluid is forced into said conduit and up into said generally vertical column or to decompress said game fluid storage container and permit the flow of fluid back from said generally vertical column, through said game fluid conduit, and into said respective game fluid reservoir, said piston member being mounted upon a shaft adapted to facilitate the motion of said piston member into and out of said game fluid storage container, reservoir control means, said reservoir control means further comprising threads on the exterior surface of said piston member shaft to receive the interior threads of a concentrically mounted cylinder upon which said piston member is positioned and piston shaft control means which are adapted to turn said threaded shaft in accordance with electrical signals received from said respective target detection means or from fluid detection means within a respective columnar fluid housing means in order to cause said fluid to either fill said generally vertical column or drain from said generally vertical column as directed and being adapted to control the movement of said piston member along said shaft; and each said respective fluid columnar housing means further comprising said generally vertical column, said generally vertical column being further adapted to permit the observation of fluid as it rises or falls within said generally vertical column by each said player and one or more said housing means fluid detection means adapted to detect the presence of fluid at a fluid level or levels.

2. The game apparatus described in claim 1 in which each said game fluid detection means comprises a float activated sensor;

said float activated sensor further comprising a float member which is suspended and free to slide along a shaft from a lower point at which there is no contact with a detector to an upper point at which said float member will contact and be detected by a sensor;

said float member being made of a material of suitable buoyancy to float when suspended within said game fluid; and said float activated sensor being adapted to send an electrical signal to a game controlling means.

3. The game apparatus described in claim 1 in which each said target detection means comprises more than one projectile stream detector, each said projectile stream detector being adapted to detect the presence of said fluid or projectile stream or light beam upon a different point or region of said target and to signal the presence of said fluid or solid projectile stream or light beam upon such region to said fluid control means.

4. The game apparatus described in claim 2 in which each said target detection means comprises more than one projectile stream detector, each said projectile stream detector being adapted to detect the presence of said fluid or projectile stream or light beam upon a different point or region of said target and to signal the presence of said fluid or solid projectile stream or light beam upon such region to a said fluid control means.

5. A competition game in which two or more players seek to cause respective columns of water to rise within a designated generally vertical column, the game apparatus comprising;

two or more player control means and targets, each said player control means further comprising a player firing mechanism which is capable of permitting a player to direct a fluid or solid projectile stream or a light beam onto or about a target, said target being further adapted with a detection means which is adapted to detect the presence of said fluid or solid projectile stream or light beam, and signalling means which is adapted to transmit a signal to a respective fluid control means during times in which a player's respective fluid or projectile stream or light beam is detected by said target detection means;

respective fluid control means, each said respective fluid control means further comprising a respective game fluid reservoir which further comprises a fluid storage container, a game fluid conduit between said game fluid storage container and a generally vertical column, and a piston member, said piston member adapted to alternatively compress the game fluid storage container so that game fluid is forced into said conduit and up into said generally vertical column or to decompress said game fluid storage container and permit the flow of fluid back from said generally vertical column, through said game fluid conduit, and into said respective game fluid reservoir, said piston member being mounted upon a shaft adapted to facilitate the motion of said piston member into and out of said game fluid storage container, reservoir control means, said reservoir control means being adapted to control the movement of said piston member along said shaft, said reservoir control means further comprising threads on the exterior surface of said piston member shaft to receive the interior threads of a concentrically mounted cylinder upon which said piston member is positioned and piston shaft control means which are adapted to turn said threaded shaft in accordance with electrical signals received from said respective target detection means or from fluid detection means within a respective columnar fluid housing means in order to cause said fluid to either fill said generally vertical column or drain from said generally vertical column as directed; and each said respective fluid columnar housing means further comprising said generally vertical column, said generally vertical column being further adapted to permit the observation of fluid as it rises or falls within said generally vertical column by each said player and one or more said housing fluid detection means adapted to detect the presence of fluid at a fluid level or levels.

6. The game apparatus described in claim 5 in which each said game fluid detection means comprises a float activated sensor;

said float activated sensor further comprising a float member which is suspended and free to slide along a shaft from a lower point at which there is no contact with a detector to an upper point at which said float member will contact and be detected by a sensor;

said float member being made of a material of suitable buoyancy to float when suspended within said game fluid; and said float activated sensor being adapted to send an electrical signal to a game controlling means.

7. The game apparatus described in claim 5 in which each said target detection means comprises more than one projectile stream detector, each said projectile stream detector being adapted to detect the presence of said fluid or projectile stream or light beam upon a different point or region of said target and to signal the presence of said fluid or solid projectile stream or light beam upon such region to a said fluid control means.

8. A competition game in which two or more players each seek to cause respective columns of water to rise within a respective generally vertical column, the game apparatus comprising;

two or more generally vertical columns, each said generally vertical column further comprising an outer column and, housed within said outer column, an inner column, said outer and inner columns being relatively positioned such that a fluid may rise within the space between each said outer column and inner column until the level of fluid rises above the top of said inner column, said inner column further being open at the top in order to permit fluid which has risen to said level to fall down into the interior of said inner column and be passed into a common fluid reservoir;

two or more player control means and targets, each said player control means further comprising a player firing mechanism which is capable of permitting a player to direct a fluid or solid projectile stream or a light beam onto or about a target, said target being further adapted with a detection means which is adapted to detect the presence of said fluid or solid projectile stream or light beam, and signalling means which is adapted to transmit a signal to a respective fluid control means during times in which a player's respective solid or fluid projectile stream or light beam is detected by said target detection means;

one or more respective fluid control means, each said respective fluid control means further comprising means to control the flow of a fluid back and forth between a respective said generally vertical column and a common fluid reservoir;

respective columnar fluid housing means, each said respective fluid columnar housing means further comprising a said generally vertical column, each said respective generally vertical column being further adapted to permit the observation of said fluid as it rises or falls within said respective vertical column by each said player; and one or more respective fluid detection means adapted to detect the presence of fluid at designated fluid levels in each said generally vertical column.

9. The game apparatus described in claim 5 in which each said target detection means comprises more than one projectile stream detector, each said projectile stream detector being adapted to detect the presence of said fluid or projectile stream or light beam upon a different point or region of said target and to signal the presence of said fluid or solid projectile stream or light beam upon such region to a said fluid control means.

10. The game apparatus described in claim 8 in which each said game fluid detection means comprises a float activated sensor;

said float activated sensor further comprising a float member which is suspended and free to slide along a shaft from a lower point at which there is no contact with a detector to an upper point at which said float member will contact and be detected by a sensor;

said float member being made of a material of suitable buoyancy to float when suspended within said game fluid; and said float activated sensor being adapted to send an electrical signal to a game controlling means.

11. The game apparatus described in claim 8 in which each said target detection means comprises more than one projectile stream detector, each said projectile stream detector being adapted to detect the presence of said fluid or projectile stream or light beam upon a different point or region of said target and to signal the presence of said fluid or solid projectile stream or light beam upon such region to a said fluid control means.

12. The game apparatus described in claim 10 in which each said target detection means comprises more than one projectile stream detector, each said projectile stream detector being adapted to detect the presence of said fluid or projectile stream or light beam upon a different point or region of said target and to signal the presence of said fluid or solid projectile stream or light beam upon such region to a said fluid control means.

13. The game apparatus described in claim 10 in which each said target detection means comprises more than one projectile stream detector, each said projectile stream detector being adapted to detect the presence of said fluid or projectile stream or light beam upon a different point or region of said target and to signal the presence of said fluid or solid projectile stream or light beam upon such region to a said fluid control means.

14. The game apparatus described in claim 8 in which each said respective fluid control means further comprises an inlet valve for pumping said column fluid into said space between said inner and outer columns from said common reservoir, an outlet valve for permitting said fluid to drain from said space back into said water main, and a conduit for permitting fluid which has fallen down into said inner column to flow back into said water main.

15. The game apparatus described in claim 14 in which each said game fluid detection means comprises a float activated sensor;

said float activated sensor further comprising a float member which is suspended and free to slide along a shaft from a lower point at which there is no contact with a detector to an upper point at which said float member will contact and be detected by a sensor;

said float member being made of a material of suitable buoyancy to float when suspended within said game fluid; and said float activated sensor being adapted to send an electrical signal to a game controlling means.

16. The game apparatus described in claim 14 in which each said target detection means comprises more than one projectile stream detector, each said projectile stream detector being adapted to detect the presence of said fluid or projectile stream or light beam upon a different point or region of said target and to signal the presence of said fluid or solid projectile stream or light beam upon such region to a said fluid control means.

17. The game apparatus described in claim 15 in which each said target detection means comprises more than one projectile stream detector, each said projectile stream detector being adapted to detect the presence of said fluid or projectile stream or light beam upon a different point or region of said target and to signal the presence of said fluid or solid projectile stream or light beam upon such region to a said fluid control means.

* * * * *